United States Patent [19]

Rule

[11] 4,138,111

[45] Feb. 6, 1979

[54] LACROSSE STICK WITH PERIPHERALLY GROOVED SUPPORT TABS

[75] Inventor: Robert J. Rule, Manhasset, N.Y.

[73] Assignee: W. H. Brine Co., Needham, Mass.

[21] Appl. No.: 774,450

[22] Filed: Mar. 4, 1977

[51] Int. Cl.[2] ..... A63B 59/02

[52] U.S. Cl. ..... 273/96 D

[58] Field of Search ..... 273/73 D, 73 H, 96 D

[56] References Cited

U.S. PATENT DOCUMENTS

| | | | |
|---|---|---|---|
| 3,086,777 | 4/1963 | Lacoste | 273/73 H |
| 3,473,806 | 10/1969 | Patterson | 273/96 D |
| 3,905,088 | 9/1975 | Tucker | 273/96 D |
| 4,034,984 | 7/1977 | Crawford | 273/73 D |

FOREIGN PATENT DOCUMENTS

| | | | |
|---|---|---|---|
| 2307942 | 9/1973 | Fed. Rep. of Germany | 273/73 D |
| 8761 of | 1884 | United Kingdom | 273/73 D |

*Primary Examiner*—Richard C. Pinkham
*Assistant Examiner*—Lawrence E. Anderson
*Attorney, Agent, or Firm*—Wolf, Greenfield & Sacks

[57] ABSTRACT

A lacrosse stick head has an encircling support frame defining an opening within which is mounted a net forming a ball pocket. Mounting tabs extend from the frame and have locating means for positively positioning a net in place so as to provide a positive lock which enables locating of a finely tuned pocket in a desired position which pocket remains in place during use.

2 Claims, 4 Drawing Figures

LACROSSE STICK WITH PERIPHERALLY GROOVED SUPPORT TABS

BACKGROUND OF THE INVENTION

Conventional lacrosse sticks have a head portion which defines an opening within which is mounted a net to form a ball pocket. In the past such stick heads have been formed of wood and other materials. More recently, plastic heads are customarily used. Some plastic heads have inwardly directed tabs which carry side wall lacing on which are mounted the webs or nets which act as ball pockets.

Players often desire to tune their stick heads, i.e., adjust the pocket to their own individual preference as baseball players often do with baseball gloves. However, in past constructions, because of the nature of the construction and stringing, it has been difficult to positively tune pockets to an individual player's taste and to maintain the pockets in desired position. The players cannot make changes in the lacrosse stick frame without violating the National Collegiate Athletic Association rules. They can, however, change the stringing to meet their individual preference.

SUMMARY OF THE INVENTION

It is an important object of this invention to provide an improved lacrosse stick head construction which enables positive positioning of a ball pocket and maintenance of that pocket in its desired position during play.

Another object of this invention is to provide an improved lacrosse stick head in accordance with the preceding object which has a plurality of mounting tabs each of which define locating means for positioning and positively locating a ball pocket in desired positions within a lacrosse stick head.

It is still another object of this invention to provide mounting tabs in accordance with the preceding object which mounting tabs are angularly positioned to increase the depth of a ball pocket and yet be out of the way of a ball when it is adjacent a side wall of the lacrosse stick head.

According to the invention, a lacrosse stick head comprises an encircling support frame which defines an opening within which is mounted a net which forms a ball pocket. The frame has first and second opposed side walls and an end wall. Mounting tabs are located on each side wall and extend generally toward the other side wall in the opening. A lacing string extends between and is tied around a plurality of the tabs on the first side wall with the tabs holding the string and having locating means for the string. The net is positioned on the lacing string and located by the locating means so as to provide a pocket in a positive preferred location which pocket is positively held in place.

Preferably the lacing string or a second lacing string extends on the second side wall and there is a plurality of similar tabs with locking means on the second side wall.

In a preferred embodiment the tabs extend downwardly from the frame at a slight angle thereto in order to increase the depth of the pocket formed by a net carried in the opening and to place the tabs slightly out of the way when the ball is on the side wall so as to not interfere with normal ball handling in the pocket.

It is a feature of this invention that increased pocket sizes can be obtained. Moreover, the invention is versatile in that various numbers of locking means can be used to provide for a variety of pocket positions. In all cases, a user of the lacrosse stick head can positively adjust a pocket in the head to his own particular desires and the pocket is substantially maintained in position during play due to the use of the locating means.

The invention minimizes playing errors caused by malfunctioning lacrosse sticks and maximizes dependence on skill to achieve success. This occurs since the pockets are positively located while in prior art devices the pockets often move or deform non-uniformly with respect to the frame.

BRIEF DESCRIPTION OF THE DRAWINGS

The above and other objects, features and advantages of the present invention will be better understood from the following specification when read in conjunction with the accompanying drawings in which.

DESCRIPTION OF PREFERRED EMBODIMENTS

Figure 1:
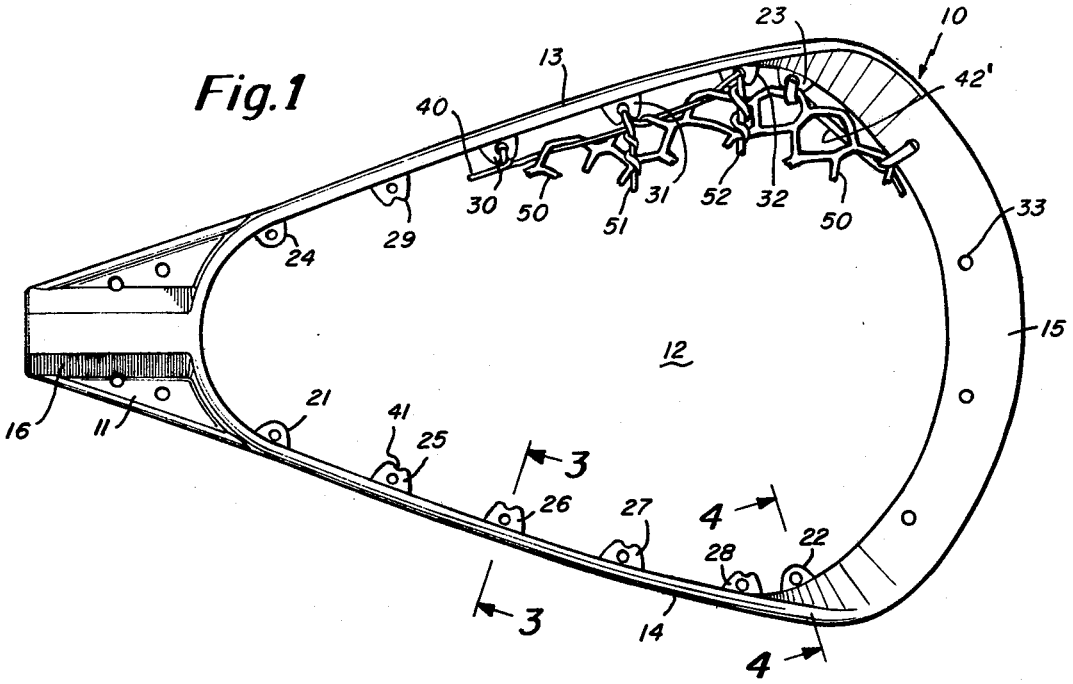
FIG. 1 is a top plan view of a preferred embodiment of a lacrosse stick head in accordance with this invention.
Figure 2:
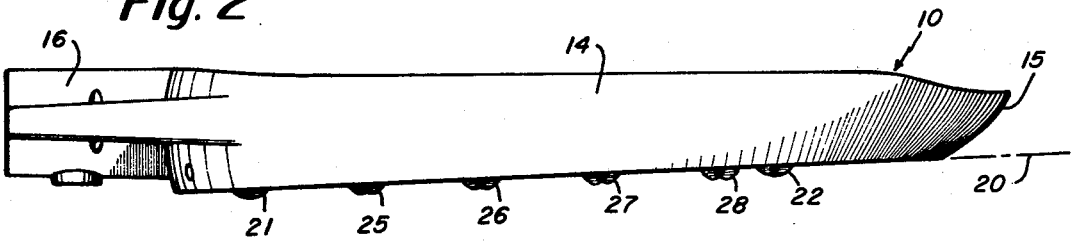
FIG.2 is a right side view thereof.

With reference now to the drawings a lacrosse stick head is shown generally at 10 in FIG. 1 and comprises a frame 11 which encircles an opening area 12 defined in part by opposing side wall sections 13 and 14 with an end scoop wall 15 and a stick attachment section 16.

As known in the art, section 16 is attached to an elongated handle or stick which is mounted therein by known means. The opening 12 ends substantially at a plane shown at 20 and has extending toward it a plurality of mounting tabs comprising a first group 21, 22, 23 and 24 and a second group 25–32. Holes 33 are provided in the end wall 15.

Figure 3:
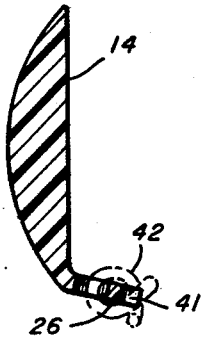
FIG. 3 is a cross sectional view thereof taken through line 3—3 thereof.
Figure 4:
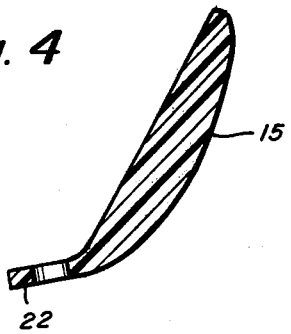
FIG. 4 is a cross sectional view thereof taken through line 4—4 thereof.

In normal stringing of the head, a side wall lacing string 40 is strung between tab 24 on the first side wall to tab 32. It should be noted that tabs 29, 30 and 31 are provided with special locating means which comprise indentations 41 in a substantially U or V shape which prevent side to side motion of the lacing string 40 when an interlooped turn 42 is used at the locating means 41 as best shown in FIG. 3. Thus these very slight indentations act to positively lock in place the side wall lacing which may be formed of nylon monofilament, multifilament or other lacing material. A second lacing string such as 40 extends between tabs 21 and 28 or the string 40 has a U shape extending all the way around to 28 as desired by a player. Tabs 22 and 23 act to mount a third lacing string 42 which is laced through the holes 33. These lacing strings mount a netting or mesh 50 as commonly used for the netting of lacrosse stick heads. The netting 50 is formed of nylon or other plastic or synthetic materials as is known and is firmly locked in place to form a desired pocket by the mounting strings. As shown in FIG. 1, the net 50 has the lacing strings 40 and 42 passing therethrough and is resiliently stretched on the strings in a substantially fixed position. Since the mounting strings cannot move axially about the tabs, positive positioning and fine tuning of net pockets as desired by individuals can be easily accomplished. Shooting strings 51 and 52 extend across the pocket as is known in the art. These shooting strings can be located on various tab arrangements as known in the art in accordance with an individual player's desire and form no part of the present invention.

The tabs which mount the lacing strings, are preferably angularly arranged with respect to a bottom plane 20 of the head. By having the tabs angle slightly downwardly as for example at angles of from 10 to 15 degrees, the pocket formed by the net is enlarged somewhat. The tabs do not get in the way of a ball carried in the pocket so that the ball can be adjacent the frame at any portion without the tabs acting to interfere with the pocket. This angular arrangement in effect increases the depth of the pocket and is highly desirable.

The invention lies primarily in the use of locking means on the tabs to prevent axial movement of the lacing strings and thus allow positive adjustment of a pocket to an individual's needs and maintenance of that pocket in a desired position throughout long time periods of play.

I claim:

1. In a lacrosse stick head having an enclosing support frame comprising two side walls and an end wall defining an opening within which is mounted a net having a ball pocket, wherein said net is mounted on a lacing string which is in turn mounted on spaced support tabs extending from the sides inward into said opening having holes therein for passage of said lacing string, the improvement comprising, locating means carried by said tabs and acting to prevent movement of said lacing string when it passes through said hole and is looped and tied over said locating means each of said locating means on said spaced support tabs on said side walls includes a peripheral groove extending generally parallel to said hole.

2. The improvement of claim 1 and further comprising said frame defining a lower plane and said tabs extending angularly downwardly from said plane.

* * * * *